US009206667B2

(12) United States Patent
Khvoshchev et al.

(10) Patent No.: US 9,206,667 B2
(45) Date of Patent: Dec. 8, 2015

(54) HYDRAULIC SYSTEM AND METHOD OF MONITORING

(71) Applicant: Schlumberger Technology Corporation, Sugar Land, TX (US)

(72) Inventors: Evgeny Khvoshchev, Abbeville Cedex (FR); Sarmad Adnan, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 14/031,730

(22) Filed: Sep. 19, 2013

(65) Prior Publication Data

US 2014/0166271 A1 Jun. 19, 2014

Related U.S. Application Data

(63) Continuation of application No. 12/259,386, filed on Oct. 28, 2008, now abandoned.

(51) Int. Cl.

| | |
|---|---|
| ***E21B 33/00*** | (2006.01) |
| ***F04B 51/00*** | (2006.01) |
| ***E21B 33/13*** | (2006.01) |
| ***E21B 34/16*** | (2006.01) |
| ***E21B 43/25*** | (2006.01) |

(52) U.S. Cl.

CPC ..... *E21B 33/13* (2013.01); *E21B 34/16* (2013.01); *E21B 43/25* (2013.01); *F04B 51/00* (2013.01)

(58) Field of Classification Search

USPC ..... 73/168; 702/114

See application file for complete search history.

(56) References Cited

U.S. PATENT DOCUMENTS

| | | | | |
|---|---|---|---|---|
| 3,921,435 | A * | 11/1975 | Howard | 374/5 |
| 4,094,191 | A | 6/1978 | Goetsch et al. | |
| 4,489,551 | A * | 12/1984 | Watanabe et al. | 60/328 |
| 5,008,841 | A | 4/1991 | McElroy | |
| 5,275,040 | A | 1/1994 | Codazzi | |
| 5,499,538 | A | 3/1996 | Glidewell et al. | |
| 5,720,598 | A | 2/1998 | de Chizzelle | |
| 5,825,657 | A | 10/1998 | Hernandez | |
| 5,943,634 | A * | 8/1999 | Piety et al. | 702/56 |
| 6,087,945 | A | 7/2000 | Yasuda | |
| 6,338,283 | B1 | 1/2002 | Navarro et al. | |
| 6,351,714 | B1 | 2/2002 | Birchmeier | |
| 6,392,584 | B1 * | 5/2002 | Eklund | 341/183 |
| 6,453,273 | B1 | 9/2002 | Qian et al. | |
| 6,675,665 | B2 | 1/2004 | Navarro et al. | |
| 6,697,741 | B2 | 2/2004 | Yu et al. | |
| 6,901,791 | B1 | 6/2005 | Frenz et al. | |

(Continued)

FOREIGN PATENT DOCUMENTS

| | | | |
|---|---|---|---|
| WO | 03091614 | A1 | 11/2003 |
| WO | 2004102052 | A1 | 11/2004 |

*Primary Examiner* — Harshad R Patel

(74) *Attorney, Agent, or Firm* — Rachel E. Greene; Tim Curington

(57) ABSTRACT

A technique involves monitoring a hydraulic system having a hydraulic pump coupled to a hydraulic motor which can be used to drive well related equipment. The system and methodology utilize sensors positioned to monitor parameters related to operation of the hydraulic pump and the hydraulic motor. A processor system is coupled to the sensors to obtain data output by the sensors. The processor system analyzes the sensor data for failure signatures that can be used to determine a failure or potential failure in the hydraulic system.

29 Claims, 3 Drawing Sheets

(56) References Cited

U.S. PATENT DOCUMENTS

| | | | |
|---|---|---|---|
| 6,968,905 | B2 | 11/2005 | Adnan et al. |
| 7,013,223 | B1 | 3/2006 | Zhang et al. |
| 7,043,975 | B2 | 5/2006 | Du |
| 7,204,138 | B2 | 4/2007 | Du et al. |
| 7,219,747 | B2 | 5/2007 | Gleitman et al. |
| 7,308,322 | B1 | 12/2007 | Discenzo et al. |
| 7,539,549 | B1 | 5/2009 | Discenzo et al. |
| 2002/0023495 | A1 | 2/2002 | Morganti |
| 2002/0124666 | A1 | 9/2002 | Navarro et al. |
| 2004/0019461 | A1* | 1/2004 | Bouse et al. ..... 702/188 |
| 2004/0230384 | A1 | 11/2004 | Haynes et al. |
| 2004/0231841 | A1 | 11/2004 | Niemeyer et al. |
| 2005/0194185 | A1 | 9/2005 | Gleitman et al. |
| 2006/0162439 | A1 | 7/2006 | Du et al. |
| 2008/0034956 | A1 | 2/2008 | Ochi et al. |

* cited by examiner

HYDRAULIC SYSTEM AND METHOD OF MONITORING

This application is a continuation application of U.S. Non-Provisional application Ser. No. 12/259,386, filed 28 Oct. 2008, which is incorporated herein by reference.

BACKGROUND

A variety of hydraulic systems are used in oilfield service equipment. Hydraulic systems often utilize a hydraulic pump coupled to and powering a hydraulic motor used to drive specific well equipment. For example, the hydraulic systems can be employed in well cementing operations, well stimulation operations, and coiled tubing services to drive centrifugal pumps, high-pressure reciprocating pumps, coiled tubing injector heads, and other types of equipment. The hydraulic systems often are used in important applications and their dependability can have a direct impact on the success of the well service. However, there are no adequate methods or devices for monitoring operation of the existing hydraulic systems to determine potential failure conditions.

SUMMARY

In general, the present invention provides a system and method of monitoring a hydraulic system having a hydraulic pump coupled to a hydraulic motor. The system and methodology utilize sensors positioned to monitor parameters, such as pressure, related to operation of the hydraulic pump and the hydraulic motor. A processor system is coupled to the sensors to obtain data output by the sensors. The processor system comprises a processor unit designed to analyze the sensor data for failure signatures that can be used to determine a failure or potential for failure in the hydraulic system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and method involving the use of a hydraulic system in a well related operation. The hydraulic system generally comprises a hydraulic pump operated to power a hydraulic motor which can be used to drive a variety of well related systems or components. For example, the hydraulic system can be used to drive centrifugal pumps, high-pressure reciprocating pumps, coiled tubing injector heads, and other components in carrying out a variety of well service operations, such as well cementing, well stimulation, coiled tubing services and other well related services. The hydraulic system may comprise either a closed loop hydraulic system or an open loop hydraulic system using, for example, a piston based hydraulic pump, such as an axial-piston or radial-piston type hydraulic pump.

Additionally, the hydraulic system comprises a monitoring and control system that obtains data on one or more parameters related to operation of the hydraulic system. The monitoring and control system may be a processor based system able to process the data in a manner that enables determination of failure signatures in the data. The failure signatures can be analyzed to determine the presence of a failure condition indicative of a failure or potential failure in the hydraulic system.

In one embodiment, the system and methodology comprise automatically monitoring the health of the hydraulic pump and hydraulic motor in a hydraulic system. The automatic health monitoring can be done in real time. By way of example, the automatic health monitoring can be accomplished based on an analysis of hydraulic pressure signals obtained from one or more pressure sensors. The system and methodology further enables generation of automatic warnings stating or predicting failures of the hydraulic system. The warnings can be provided audibly and/or visually through visual indicators, such as icons, graphs, or text indicating the failure or potential failure. The warnings allow the monitored hydraulic system or portions of the hydraulic system to be taken out of service before the occurrence of more serious conditions.

Figure 1:
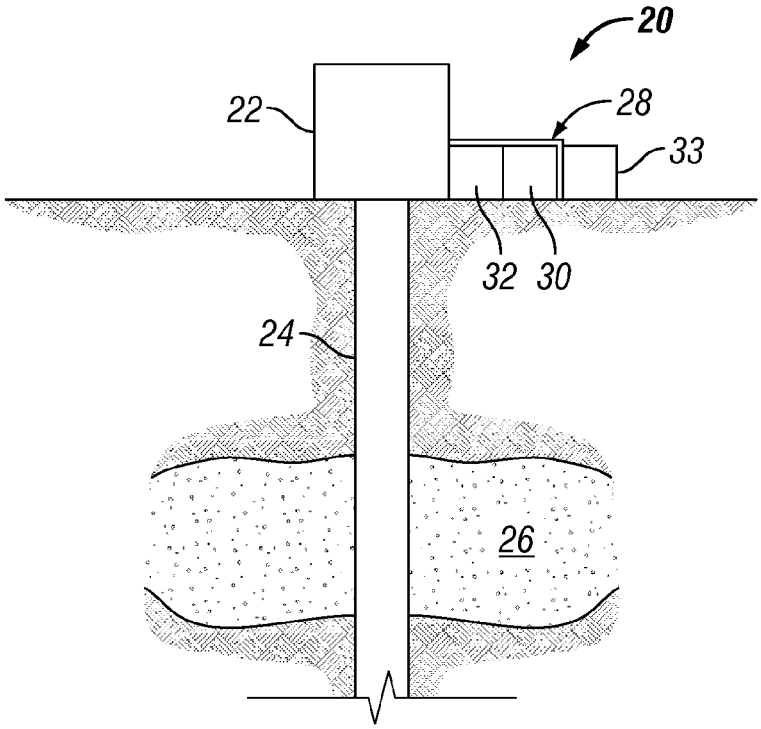
FIG. 1 is a schematic front elevation view of a well system having a hydraulic system utilizing a hydraulic motor and a hydraulic pump, according to an embodiment of the present invention.

Referring generally to FIG. 1, an example of a well system 20 is illustrated according to embodiment of the present invention. The well system 20 comprises a surface structure 22, such as a rig, positioned above a wellbore 24 that extends into a subterranean region 26. The well system 20 further comprises a hydraulic system 28 used in performing an oilfield service operation, such as, but not limited to, well cementing, a well trement operation such as well stimulation, coiled tubing services, or for powering wellsite surface equipment, such as a wireline drum for wireline logging, and/or auxiliary equipment such as centrifugal pumps and cooling fans, or the like. The hydraulic system 28 can be coupled to a variety of components and systems depending on the specific oilfield service operation to be conducted. As described above, the hydraulic system 28 can be used to drive coiled tubing injector heads, a variety of pumps, and other well components, equipment, and systems.

Generally, hydraulic system 28 comprises a hydraulic pump 30 coupled to a hydraulic motor 32 to power the hydraulic motor. The hydraulic motor, in turn, can be connected to the appropriate well component, e.g. coiled tubing injector head, centrifugal pump, high-pressure reciprocating pump, a hydraulic power cylinder, or other component. By way of example, hydraulic pump 30 may comprise a piston-type pump, e.g. an axial-piston hydraulic pump or a radial-piston hydraulic pump, driven by a suitable power source 33.

Figure 2:
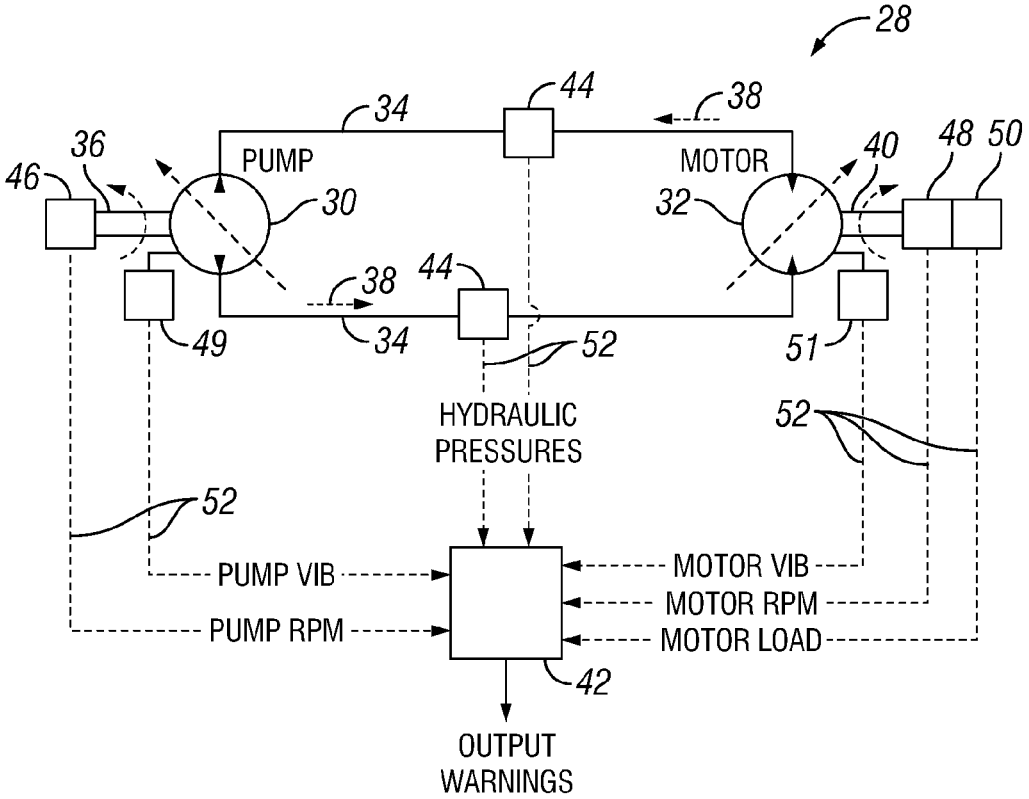
FIG. 2 is a schematic illustration of one example of a hydraulic pumping system, according to an embodiment of the present invention.

Referring generally to FIG. 2, one embodiment of hydraulic system 28 is schematically illustrated. In this embodiment, hydraulic pump 30 is coupled to hydraulic motor 32 via one or more hydraulic lines 34 which may be arranged in a closed loop or open loop configuration. The hydraulic pump 30 may be operated by rotation of a pump shaft 36 which may be rotated via, for example, power source 32. Operation of hydraulic pump 30 serves to pump hydraulic fluid to hydraulic motor 32, as illustrated by arrows 38. As the hydraulic fluid is pumped through hydraulic motor 32, the hydraulic motor is rotated and outputs power via hydraulic motor shaft 40.

In the embodiment illustrated, hydraulic system 28 further comprises a processing system 42, such as a monitoring and control system, coupled to a plurality of sensors disposed throughout hydraulic system 28. By way of example, the plurality of sensors may comprise one or more hydraulic sensors 44 for measuring pressure in the hydraulic line or hydraulic lines 34. In one embodiment, the hydraulic sensors 44 are positioned along the hydraulic lines 34, although the specific position of the hydraulic sensors can vary depending on the hydraulic system configuration. For example, one or more hydraulic pressure sensors 44 can be installed in the hydraulic line 34 on the hydraulic pump discharge side near the hydraulic pump, and one or more additional hydraulic pressure sensors 44 can be installed in the hydraulic line 34 on the hydraulic motor pressure side near the hydraulic motor 32.

The plurality of sensors also may comprise a variety of additional sensors to detect and monitor a variety of other hydraulic system related parameters. By way of example, the sensors may comprise a pump speed sensor 46, a motor speed sensor 48, and a motor load sensor 50. The pump speed sensor 46 may be installed on the hydraulic pump input shaft 36 to measure the rotational frequency of the hydraulic pump 30. Similarly, the motor speed sensor 48 may be installed on the hydraulic motor output shaft 40 to measure the rotational frequency of the hydraulic motor 32. Motor load sensor 50 is designed to measure the load on hydraulic motor 32 and may comprise a motor torque sensor, a pump discharge pressure sensor (if the hydraulic motor drives a positive displacement pump), a coiled tubing weight sensor for an injector head motor drive, or another type of suitable load sensor. The system 28 may further comprise at least one pump vibration sensor 49 operatively coupled to the pump 30 and at least one motor vibration sensor 51 operatively coupled to the motor 32. The vibration sensors 49 and 51 may be, but are not limited to, an accelerometer, a vibration speed sensor, and a vibration displacement sensor. The vibration sensors 49 and 51 may be attached directly to the body or housing of the pump 30 and motor 32, respectively. Alternatively, the vibration sensors 49 and 51 are attached at any location suitable for measuring vibration of the pump 30 and motor 32 or other mechanical components of the system 28.

The plurality of sensors 44, 46, 48, 49, 50, and 51 are operatively coupled with processing system 42 via a plurality of communication lines 52. The type of communication line may vary within the hydraulic system 28 depending on the specific type of sensor used to monitor the desired hydraulic system parameter. By way of example, the communication lines 52 may comprise hydraulic lines, electrical lines, fiber optic lines, wireless communication lines, and other suitable communication lines for conveying signals from the sensors to processing system 42 in real-time. Processing system 42 is able to process and analyze the real-time data obtained from the one or more hydraulic system pressure sensors, vibration sensors, and other parameter sensors to monitor the health of hydraulic system 28. For example, processing system 42 can be utilized to analyze a series of hydraulic pressure data to look for failure signatures in frequency and time domains, as discussed in greater detail below.

Figure 3:
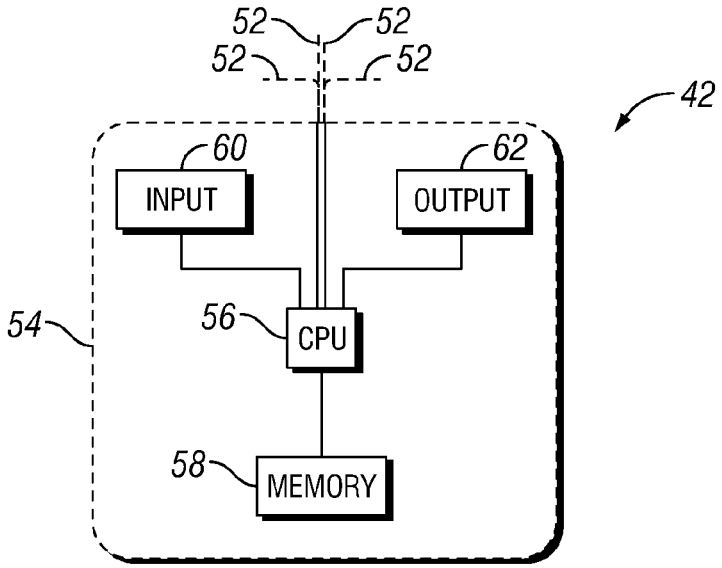
FIG. 3 is a schematic representation of an example of a monitoring and control system that can be used in the hydraulic pumping system illustrated in FIG. 2, according to an embodiment of the present invention.

Processing system 42 may comprise a variety of monitoring and/or control configurations, however one embodiment of processing system 42 is a computer-based processing system, as illustrated schematically in FIG. 3. The methodology described herein may be carried out by a computer-based controller 54 able to automate the data accumulation, processing, analysis, and/or control functions related to hydraulic system 28. The computer-based controller 54 comprises a processing unit 56 such as a central processing unit (CPU). The CPU 56 may be operatively coupled to sensors 44, 46, 48, 50 through communication lines 52 and to other components of computer-based controller 54. For example, the CPU 56 may be operatively coupled to a memory 58, an input device 60 and an output device 62.

Input device 60 may comprise a variety of devices, such as a keyboard, mouse, voice-recognition unit, touchscreen, other input devices, or combinations of such devices. Output device 62 may comprise a visual and/or audio output device, such as a monitor having a graphical user interface to present information to an operator. For example, information can be provided to indicate hydraulic system 28 is operating within desired parameters or to indicate a failure condition that reflects an actual or potential failure in the hydraulic system. Additionally, the processing may be done on a single device or multiple devices at the well location, away from the well location, or with some devices located at the well and other devices located remotely.

Figure 4:
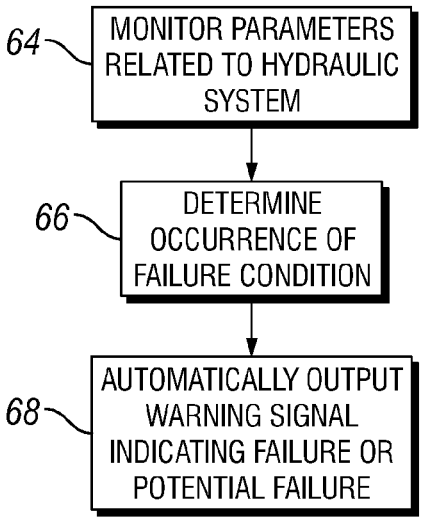
FIG. 4 is a flow chart representing an example of a methodology for implementing monitoring and control of the hydraulic system, according to an embodiment of the present invention.

In FIG. 4, a flow chart is provided to illustrate a general functionality of processing system 42 that may be carried out on the computer-based controller 54. In this example, processing system 42 is used to monitor parameters related to hydraulic system 28, as illustrated by block 64. The monitoring is accomplished by processing data from system parameter sensors, e.g. hydraulic sensors 44, to determine the occurrence of a failure condition, as illustrated by block 66. If a failure condition is determined, the processing system 42 automatically outputs a warning signal indicating a failure or potential failure, as illustrated by block 68. The warning signal can be provided through output device 62 via, for example, visual information and/or audio information.

Figure 5:
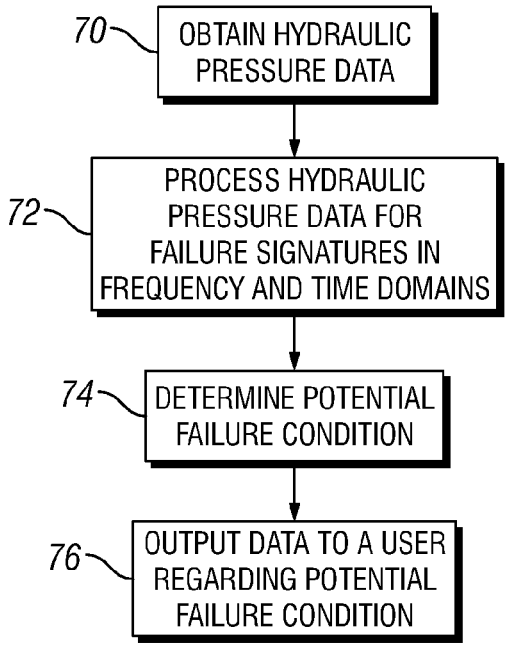
FIG. 5 is a flow chart representing another example of a methodology for implementing monitoring and control of the hydraulic system, according to an alternate embodiment of the present invention.

The processing system 42 can be designed and programmed to determine the occurrence of failure conditions by processing data from one or more of the hydraulic system sensors. One approach is illustrated by the flowchart of FIG. 5. In this embodiment, hydraulic pressure data is obtained by monitoring hydraulic pressure via the one or more hydraulic pressure sensors 44, as indicated by block 70. The hydraulic pressure data is sent to processing system 42, and the data is processed for failure signatures in frequency and time domains, as illustrated by block 72. The automatic analysis of hydraulic pressure data enables the processing system 42 to determine potential, or actual, failure conditions in hydraulic system 28, as illustrated by block 74. If a failure condition is determined, the processing system 42 automatically outputs data to a user regarding the potential failure condition, as illustrated by block 76. For example, information can be output in the form of a warning via output device 62 which may comprise a computer display, e.g. a computer monitor. It also should be noted that processing system 42 can output data indicating hydraulic system 28 is operating properly within desired parameters.

Figure 6:
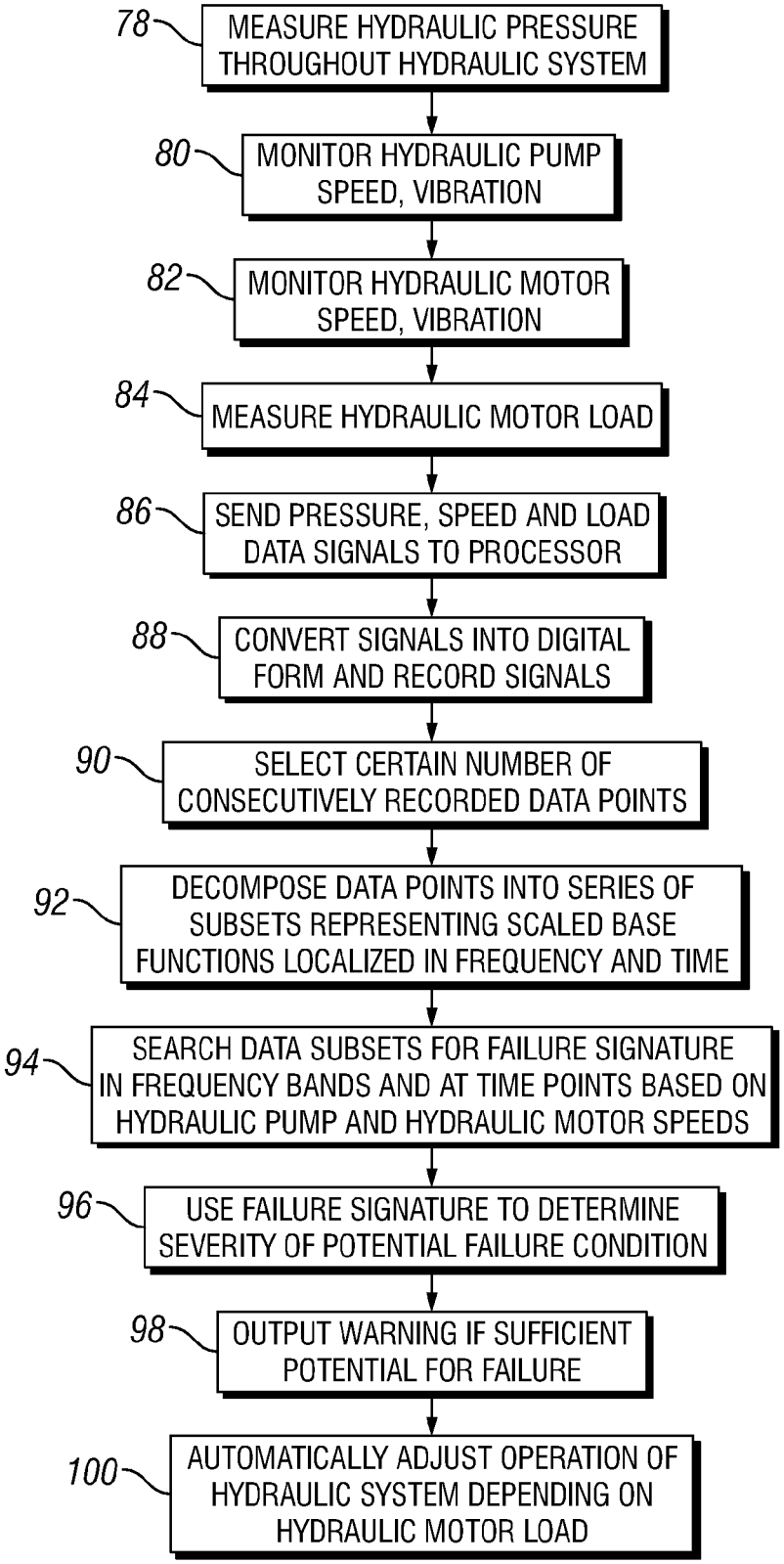
FIG. 6 is a flow chart representing another example of a methodology for implementing monitoring and control of the hydraulic system, according to an alternate embodiment of the present invention.

A specific example of the use of processing system 42 (in cooperation with sensors 44, 46, 48, 49, 50, and 51) during operation of hydraulic system 28 is provided by the flowchart illustrated in FIG. 6. In this embodiment, processing system 42 is used to measure hydraulic pressure throughout the hydraulic system 28, as illustrated by block 78. Hydraulic sensors 44 can be disposed along the one or more hydraulic lines 34 and/or within hydraulic pump 30 and hydraulic motor 32. By way of example, one hydraulic pressure sensor 44 can be disposed in a pump discharge segment of hydraulic line 34, and another hydraulic pressure sensor 44 can be installed in a hydraulic motor pressure section of hydraulic line 34.

As illustrated, processing system 42 also is designed to monitor hydraulic pump speed and vibration via one or more hydraulic pump speed sensors 46 and vibration sensors 49, as illustrated by block 80. Similarly, system 42 receives data from one or more hydraulic motor speed sensors 48 and vibration sensors 51 to monitor hydraulic motor speed and vibration, has illustrated by block 82. Those skilled in the art will appreciate that speed and vibration need not be measured concurrently as illustrated by blocks 80 and 82 but may be performed separately, in sequence, or independently. In some applications, the load on hydraulic motor 32 also can be measured via motor load sensor 50, as indicated by block 84. Signals output by the hydraulic sensors, speed sensors, load sensors, and vibration sensors are sent to the computer-based controller 54 of processing system 42, as represented by block 86. In this embodiment, the signals are provided to processing system 42 in real-time.

Once the sensor signal data is received by processing system 42, the signal data is converted into digital form and recorded in a suitable memory, such as memory 58, as illustrated by block 88. By way of example, the processing system 42 can be designed to record data at a rate of a hundred times per second or more. In this embodiment, processing system 42 comprises an algorithm designed to select a certain number of consecutively recorded data points, as illustrated by block 90. The consecutively recorded data points are decomposed by the processing system 42 into a series of subsets representing scaled base functions localized in frequency and time, as illustrated by block 92. The data subsets can then be searched for failure signatures, as illustrated in block 94. The failure signatures can be found in frequency bands and at time points based on hydraulic pump and hydraulic motor speeds provided by speed sensors 46 and 48, respectively. The scaled base functions may be selected depending on type of failure that the system 42 is to detect and one base function may be used for detecting one or more failure signatures. The base function may be one of many wavelets and the searching of data subsets in block 94 may be wavelet analysis. The scaled base function may be a simple sine wave so the process of block 94 is Fourier analysis. Alternatively, the searching of block 94 may be pattern analysis. During operation, the system 42 preferably cycles through all available base functions to detect different failure signatures.

If the processed data provides signatures indicative of failure, those signatures are analyzed via processing system 42 to determine the severity of actual or potential failure conditions, as illustrated by block 96. If a failure has occurred or if there exists sufficient potential for failure, processing system 42 automatically outputs a warning, as illustrated by block 98. For example, the visual and/or audible warning may be provided via output device 62. In some applications, processing system 42 also may be programmed with suitable control features to automatically adjust operation of the hydraulic system 28 based on the determined potential for failure, as illustrated by block 100. The adjustments are subject to hydraulic motor load information provided by motor load sensor 50.

The overall well system 20 can be constructed in a variety of configurations for use in many environments and applications. For example, various types of hydraulic pumps and hydraulic motors can be combined in hydraulic system 28. Additionally, the hydraulic pump 30 can be rotated via a variety of power sources, and the hydraulic motor 32 can be connected to drive various well components or systems. Furthermore, the hydraulic system 28 can be designed as a closed-circuit or open circuit system with hydraulic sensors located at various positions along the hydraulic system. Many types of additional sensors also can be incorporated into the system to detect and monitor a variety of parameters related to operation of the hydraulic system 28. The processing system 42 can be designed and programmed according to different forms, and the system can be physically positioned at one or more locations. A variety of programs, algorithms, and other processing tools can be used in processing system 42 to carry out the methodology described herein.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of monitoring a hydraulic system deployed on a surface of a well site, comprising:

coupling a hydraulic pump adapted for use in at least one of a well cementing operation, a well stimulation operation, and a coiled tubing service with a hydraulic motor via a hydraulic line;

deploying a pressure sensor to measure pressure in the hydraulic line;

processing consecutively recorded data points of a hydraulic pressure signal received from the pressure sensor to decompose the consecutively recorded data points into a series of data subsets representing scaled base functions localized in frequency and time;

using a processor to search the series of data subsets for failure signatures in frequency and time domains; and outputting an indication as to whether a failure condition of the hydraulic system is found.

2. The method as recited in claim 1, wherein coupling comprises coupling the hydraulic pump with the hydraulic motor in a closed loop configuration.

3. The method as recited in claim 1, wherein deploying comprises deploying a plurality of pressure sensors along the hydraulic line.

4. The method as recited in claim 1, wherein processing comprises processing the consecutively recorded data points on a computer-based system.

5. The method as recited in claim 1, wherein processing comprises processing data on pump speed and motor speed.

6. The method as recited in claim 5, wherein processing comprises processing data on motor load.

7. The method as recited in claim 1, wherein processing comprises processing data on one of pump vibration and motor vibration.

8. The method as recited in claim 1, wherein using the processor comprises searching for the failure signatures in frequency bands and at time points that depend on speeds of the hydraulic pump and the hydraulic motor.

9. The method as recited in claim 1, wherein outputting comprises displaying information related to the failure signatures on a computer display.

10. The method as recited in claim 1, wherein outputting comprises displaying information indicating operation of the hydraulic system within acceptable parameters.

11. A method, comprising:

deploying pressure sensors in a hydraulic system located on a surface of a well site and adapted for use in at least one of a well cementing operation, a well stimulation operation, and a coiled tubing service, the hydraulic system having a hydraulic motor powered by a hydraulic pump;

operatively coupling the pressure sensors to a processing system;

using the pressure sensors to obtain a certain number of consecutively recorded data points based on hydraulic pressure signals; and processing the consecutively recorded data points on the processor system so that the consecutively recorded data points are decomposed into a series of data subsets representing scaled base functions that can be used to determine a failure signature in frequency and time domains of the hydraulic system.

12. The method as recited in claim 11, further comprising operatively coupling additional sensors to the processing system.

13. The method as recited in claim 12, wherein operatively coupling additional sensors comprises coupling a hydraulic pump speed sensor, a hydraulic motor speed sensor, at least one vibration sensor, and a motor load sensor to the processing system.

14. The method as recited in claim 11, wherein processing comprises processing in real-time the consecutively recorded data points so the consecutively recorded data points are decomposed into the series of data subsets representing scaled base functions localized in frequency and time.

15. The method as recited in claim 14, further comprising searching the series of data subsets for the failure signature in frequency bands and at time points that depend on hydraulic pump speed and hydraulic motor speed.

16. The method as recited in claim 11, further comprising outputting an indication as to an operational state of the hydraulic system.

17. The method as recited in claim 16, wherein outputting comprises outputting a warning indicating a failure condition based on the failure signature.

18. The method as recited in claim 11, further comprising performing an oilfield services operation with the hydraulic system.

19. A system deployed on a surface of a well site, comprising:

a hydraulic pump;

a hydraulic motor coupled to the hydraulic pump via a hydraulic line;

a plurality of sensors positioned to monitor parameters related to operation of the hydraulic pump and the hydraulic motor; and a processor system coupled to the plurality of sensors to obtain data from the sensors, the processor system having a processor unit to analyze the data for failure signatures in frequency and time domains and indicate a failure condition of one of the hydraulic pump, the hydraulic motor and the hydraulic line.

20. The system as recited in claim 19, wherein the hydraulic pump comprises a piston based pump.

21. The system as recited in claim 19, wherein the plurality of sensors comprises a pressure sensor to monitor pressure in the hydraulic line.

22. The system as recited in claim 19, wherein the plurality of sensors comprises a hydraulic pump speed sensor and a hydraulic motor speed sensor.

23. The system as recited in claim 19, wherein the plurality of sensors comprises a hydraulic motor load sensor.

24. The system as recited in claim 19, wherein the plurality of sensors comprises at least one pump vibration sensor and at least one motor vibration sensor.

25. The system as recited in claim 19, wherein the processor system comprises an output device through which a warning, based on a failure signature, is automatically provided to an operator.

26. A method, comprising:

measuring hydraulic pressure in a hydraulic line connecting a hydraulic motor with a hydraulic pump adapted for use in at least one of a well cementing operation, a well stimulation operation, and a coiled tubing service;

monitoring hydraulic pump speed with a hydraulic pump speed sensor;

monitoring hydraulic motor speed with a hydraulic motor speed sensor;

outputting data on the hydraulic pressure, hydraulic pump speed, and hydraulic motor speed to a processor system; and using the processor system to automatically monitor the data for a failure condition related to operation of the hydraulic motor and the hydraulic pump by searching for failure signatures in frequency and time domains of the data.

27. The method as recited in claim 26, wherein using comprises using in real-time consecutively recorded data points, on hydraulic pressure, decomposed into a series of data subsets representing scaled base functions localized in frequency and time.

28. The method as recited in claim 26, wherein using comprises using in real-time consecutively recorded data points, on pump or motor vibration, decomposed into a series of data subsets representing scaled base functions localized in frequency and time.

29. The method as recited in claim 26, wherein searching comprises one of wavelet analysis, pattern analysis, and Fourier analysis.

* * * * *